US009475289B2

(12) United States Patent
Yazaki

(10) Patent No.: US 9,475,289 B2
(45) Date of Patent: Oct. 25, 2016

(54) LIQUID EJECTING HEAD, LIQUID EJECTING APPARATUS, AND PIEZOELECTRIC DEVICE

(71) Applicant: SEIKO EPSON CORPORATION, Tokyo (JP)

(72) Inventor: Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/874,053

(22) Filed: Oct. 2, 2015

(65) Prior Publication Data

US 2016/0096368 A1 Apr. 7, 2016

(30) Foreign Application Priority Data

Oct. 2, 2014 (JP) ..... 2014-204293

(51) Int. Cl.
*B41J 2/14* (2006.01)

(52) U.S. Cl.
CPC ..... *B41J 2/14233* (2013.01); *B41J 2/14* (2013.01); *B41J 2/14201* (2013.01); *B41J 2/14274* (2013.01)

(58) Field of Classification Search
None
See application file for complete search history.

(56) References Cited

U.S. PATENT DOCUMENTS

| | | | | |
|---|---|---|---|---|
| 6,336,717 | B1 | 1/2002 | Shimada et al. | |
| 2003/0210308 | A1 | 11/2003 | Okubo | |
| 2009/0284568 | A1* | 11/2009 | Yazaki | B41J 2/055 347/68 |
| 2011/0007114 | A1 | 1/2011 | Nakayama | |

FOREIGN PATENT DOCUMENTS

| | | |
|---|---|---|
| CN | 1486792 | 4/2004 |
| EP | 1 486 331 | 12/2004 |
| EP | 2 305 471 | 4/2011 |
| JP | 2009-172878 | 8/2009 |

OTHER PUBLICATIONS

European Search Report for Application No. 15187637.2 dated Jun. 2, 2016.

* cited by examiner

*Primary Examiner* — Lisa M Solomon
(74) *Attorney, Agent, or Firm* — Workman Nydegger

(57) ABSTRACT

A liquid ejecting head includes a flow channel forming substrate that is provided with a space constituting a pressure generating chamber which communicates with nozzle openings, a vibration plate that is stacked on one surface of the flow channel forming substrate and seals the space, and a piezoelectric element that includes a first electrode, a piezoelectric layer, and a second electrode sequentially stacked on a surface of the vibration plate opposite to the flow channel forming substrate, in which the first electrode is formed, in which at least a width of a first direction along the opposite surface is narrower than the space in a region corresponding to the space, the piezoelectric layer is stacked so as to overlap the first electrode and at least a part of the vibration plate in the region corresponding to the space, the second electrode is stacked so as to overlap the piezoelectric layer in the region corresponding to the space, and as a thickness of a stacked direction of the piezoelectric element is a thickness of the piezoelectric layer, a first thickness (D1) of the piezoelectric layer of a part positioned on the first electrode and a second thickness (D2) of the piezoelectric layer of a part positioned on the vibration plate satisfy a relationship of the first thickness (D1)>the second thickness (D2).

13 Claims, 11 Drawing Sheets

LIQUID EJECTING HEAD, LIQUID EJECTING APPARATUS, AND PIEZOELECTRIC DEVICE

CROSS-REFERENCE TO RELATED APPLICATIONS

The entire disclosure of Japanese Patent Application No: 2014-204293, filed Oct. 2, 2014 is expressly incorporated by reference herein in its entirety.

BACKGROUND

1. Technical Field

The present invention relates to a liquid ejecting head, a liquid ejecting apparatus, and a piezoelectric device.

2. Related Art

In the related art, as a representative example of a liquid ejecting head which discharges liquid droplets, an ink jet recording head which discharges ink has been known. As the ink jet recording head, for example, an ink jet recording head has been known in which a piezoelectric element, which is configured to have a lower electrode, a piezoelectric layer, and a upper electrode, is formed on a vibration plate provided on one surface of a flow channel forming substrate, the lower electrode is a separate electrode formed corresponding to each pressure generating chamber, and an upper electrode is a common electrode formed throughout a plurality of the pressure generating chambers.

As such a recording head, a recording head is proposed in which an upper surface and an end surface of the piezoelectric layer in a region facing the pressure generating chamber is covered with the upper electrode (common electrode), and a distance d1 between an upper surface of the lower electrode (separated electrode) and an upper surface of the piezoelectric layer and a distance d2 between an end surface of the lower electrode and an end surface of the piezoelectric layer satisfy a relationship of d2≥d1 (for example, referring to JP-A-2009-172878).

However, there is a strong demand for a recording head that realizes both securing reliability and excellent displacement properties on the basis of a background of miniaturizing a liquid ejecting head in recent. As disclosed in JP-A-2009-172878, in the recording head in which a lower electrode is a separated electrode and an upper electrode is a common electrode, the upper surface of the piezoelectric layer is generally flat in a manufacturing process; however, even such a recording head is required to be improved in terms of realizing both securing reliability and excellent displacement properties. Moreover, such a problem is not limited to the ink jet recording head, but also exists in the liquid ejecting head which discharges other liquid. In addition, the problem exists even in various piezoelectric devices in which a piezoelectric element is used in an actuator, a sensor, or the like.

SUMMARY

An advantage of some aspects of the invention is to provide a liquid ejecting head, a liquid ejecting apparatus, and a piezoelectric device which can realize both securing reliability and excellent displacement properties.

According to an aspect of the invention, there is provided a liquid ejecting head which includes a flow channel forming substrate that is provided with a space constituting a pressure generating chamber which communicates with nozzle openings, a vibration plate that is stacked on one surface of the flow channel forming substrate and seals the space, and a piezoelectric element that includes a first electrode, a piezoelectric layer, and a second electrode sequentially stacked on a surface of the vibration plate opposite to the flow channel forming substrate, in which the first electrode is formed, in which at least a width of a first direction along the opposite surface is narrower than the space in a region corresponding to the space, the piezoelectric layer is stacked so as to overlap the first electrode and at least a part of the vibration plate in the region corresponding to the space, the second electrode is stacked so as to overlap the piezoelectric layer in the region corresponding to the space, and when a thickness of a stacked direction of the piezoelectric element is a thickness of the piezoelectric layer, a first thickness (D1) of the piezoelectric layer of a part positioned on the first electrode and a second thickness (D2) of the piezoelectric layer of a part positioned on the vibration plate satisfy a relationship of the first thickness (D1)>the second thickness (D2).

According to the aspect, as the first thickness (D1) can be secured, electric field intensity generated between the electrodes by applying a driving voltage can be suitably reduced. In addition, while suitably securing the first thickness (D1) as such a suitable thickness, the second thickness (D2) is not unnecessarily thick, and thus, an excessive hindrance of a displacement of the piezoelectric element can be avoided. Accordingly, both securing the reliability and excellent displacement properties can be realized.

It is preferable that the first thickness (D1) is a thickness of the piezoelectric layer of a position including at least the center of the first direction in a part positioned on the first electrode. According to the aspect, a relationship of the first thickness (D1)>the second thickness (D2) is satisfied at least in the center of a width direction, and the electric field intensity generated between the electrodes by applying the driving voltage can be efficiently reduced. Accordingly, both securing the reliability and excellent displacement properties can be realized.

In addition, it is preferable that the first electrode includes a side surface which is inclined upwardly toward the center of the first direction, and an upper surface formed continuously to the side surface, a ratio (first thickness (D1)/third thickness (D3)) of the first thickness (D1) to the third thickness (D3) of the piezoelectric layer on a boundary between the side surface and the upper surface, which is positioned on the first direction in the first electrode, is 90% or more. According to the aspect, since the first thickness (D1) is formed to secure an appropriate thickness, including an end portion of a width direction of the piezoelectric layer of a part positioned on the first electrode, the electric field intensity generated between the electrodes by applying the driving voltage can be reliably reduced. Accordingly, both securing the reliability and the excellent displacement properties can be further realized.

In addition, it is preferable that the piezoelectric layer includes a first side surface which is inclined upwardly toward the center of the first direction, and a first upper surface formed continuously to the first side surface, and a convex portion, which is wider than the first electrode in the first direction and is convex in a direction opposite to the vibration plate, is provided on the first upper surface. Accordingly, a configuration in which the relationship of the first thickness (D1)>the second thickness (D2) is satisfied is easily realized. According to the aspect, both securing the reliability and the excellent displacement properties are easily realized.

In addition, it is preferable that the convex portion is configured to have a second side surface inclined upwardly toward the center of the first direction and a second upper surface formed continuously to the second side surface, and a first thickness (D1) is a distance between an upper surface of the first electrode and the second upper surface of the convex portion of the piezoelectric layer, and a second thickness (D2) is a distance between the vibration plate and the first upper surface of the piezoelectric layer. According to the aspect, since the first thickness (D1) or the second thickness (D2) is suitably obtained, both securing the reliability and the excellent displacement properties are reliably realized.

In addition, it is preferable that the piezoelectric element is configured to have a first piezoelectric layer that is formed by patterning at the same time as the first electrode and positioned on the first electrode and a second piezoelectric layer covering the first piezoelectric layer and the first electrode at least in the first direction, and a fourth thickness (D4) of the convex portion in the second piezoelectric layer and a fifth thickness (D5) of the first electrode and the first piezoelectric layer satisfy a relationship of the fifth thickness (D5)>the fourth thickness (D4). According to the aspect, excessive increasing of the fourth thickness (D4) can be prevented, as a result, while satisfying the relationship of the first thickness (D1)>the second thickness (D2), deterioration of the displacement properties due to an excessive increasing of the first thickness (D1) can be prevented. Therefore, both securing the reliability and the excellent displacement properties can be realized.

In addition, it is preferable that a sixth thickness (D6) of the second piezoelectric layer between the upper surface of the first piezoelectric layer and the second upper surface of the convex portion of the second piezoelectric layer, and the second thickness (D2) satisfy a relationship of the second thickness (D2)>the sixth thickness (D6). According to the aspect, since a relationship of the first thickness (D1)>the second thickness (D2)>the sixth thickness (D6) is satisfied, generation of unnecessary electric field intensity due to an excessive reduction of the second thickness (D2) can be prevented. Therefore, both securing the reliability and the excellent displacement properties can be realized.

According to another aspect of the invention, there is provided a liquid ejecting apparatus which includes the liquid ejecting head according to any one of the above described descriptions. According to the aspect, both securing the reliability and the excellent displacement properties can be realized.

In addition, according to still another aspect of the invention, there is provided a piezoelectric device which includes a substrate that includes at least one space, a vibration plate that is stacked on one surface of the substrate and seals the space, and a piezoelectric element that includes a first electrode, a piezoelectric layer, and a second electrode sequentially stacked on a surface of the vibration plate opposite to the substrate, in which the first electrode is formed, in which at least a width of a first direction along the opposite surface is narrower than the space in a region corresponding to the space, the piezoelectric layer is stacked so as to overlap the first electrode and at least a part of the vibration plate in the region corresponding to the space, the second electrode is stacked so as to overlap the piezoelectric layer in the region corresponding to the space, and when a thickness of a stacked direction of the piezoelectric element is a thickness of the piezoelectric layer, a first thickness (D1) of the piezoelectric layer of a part positioned on the first electrode and a second thickness (D2) of the piezoelectric layer of a part positioned on the vibration plate satisfy a relationship of the first thickness (D1)>the second thickness (D2). According to the aspect, both securing the reliability and the excellent displacement properties can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
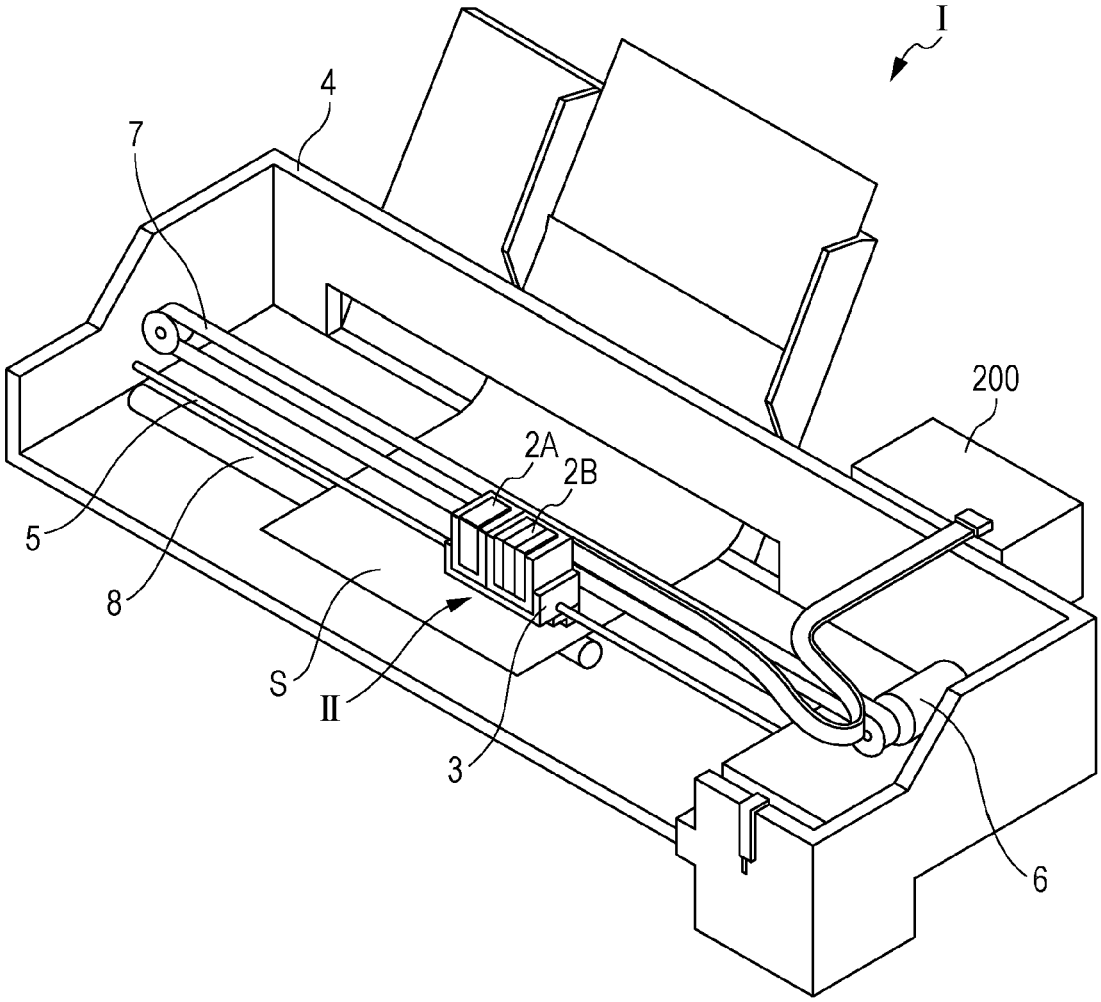
FIG. 1 is a view illustrating a schematic configuration of a recording apparatus according to a first embodiment.

FIG. 1 is a view illustrating a schematic configuration of an ink jet recording apparatus which is an example of a liquid ejecting apparatus according to a first embodiment of the invention.

As illustrated in drawings, in the ink jet recording apparatus I, cartridges 2A and 2B constituting ink supplying means are detachably formed in an ink jet recording head unit (head unit) II including a plurality of ink jet recording heads. The carriage 3 on which the head unit II is mounted is formed in a carriage axis 5 which is attached to an apparatus main body 4 to be movable in an axis direction, and for example, respectively discharges a black ink composition and a color ink composition.

In addition, driving force of a driving motor 6 is transferred to the carriage 3 through a plurality of gears (not illustrated) and a timing belt 7, and the carriage 3 on which the head unit II is mounted is formed so as to move along a carriage axis 5. Meanwhile, a transportation roller 8 is formed in the apparatus main body 4 as transportation means, and a recording sheet S which is a recording medium such as paper is transported by the transportation roller 8. Moreover, the transportation means for transporting the recording sheet S is not limited to the transportation roller, and may be a belt, a drum, or the like.

Since in such an ink jet recording apparatus I, as an ink jet recording head, the ink jet recording head (may be simply referred to as "recording head") according to a first embodiment to be described hereinbelow is mounted, both reliability and excellent displacement properties can be secured.

Figure 2:
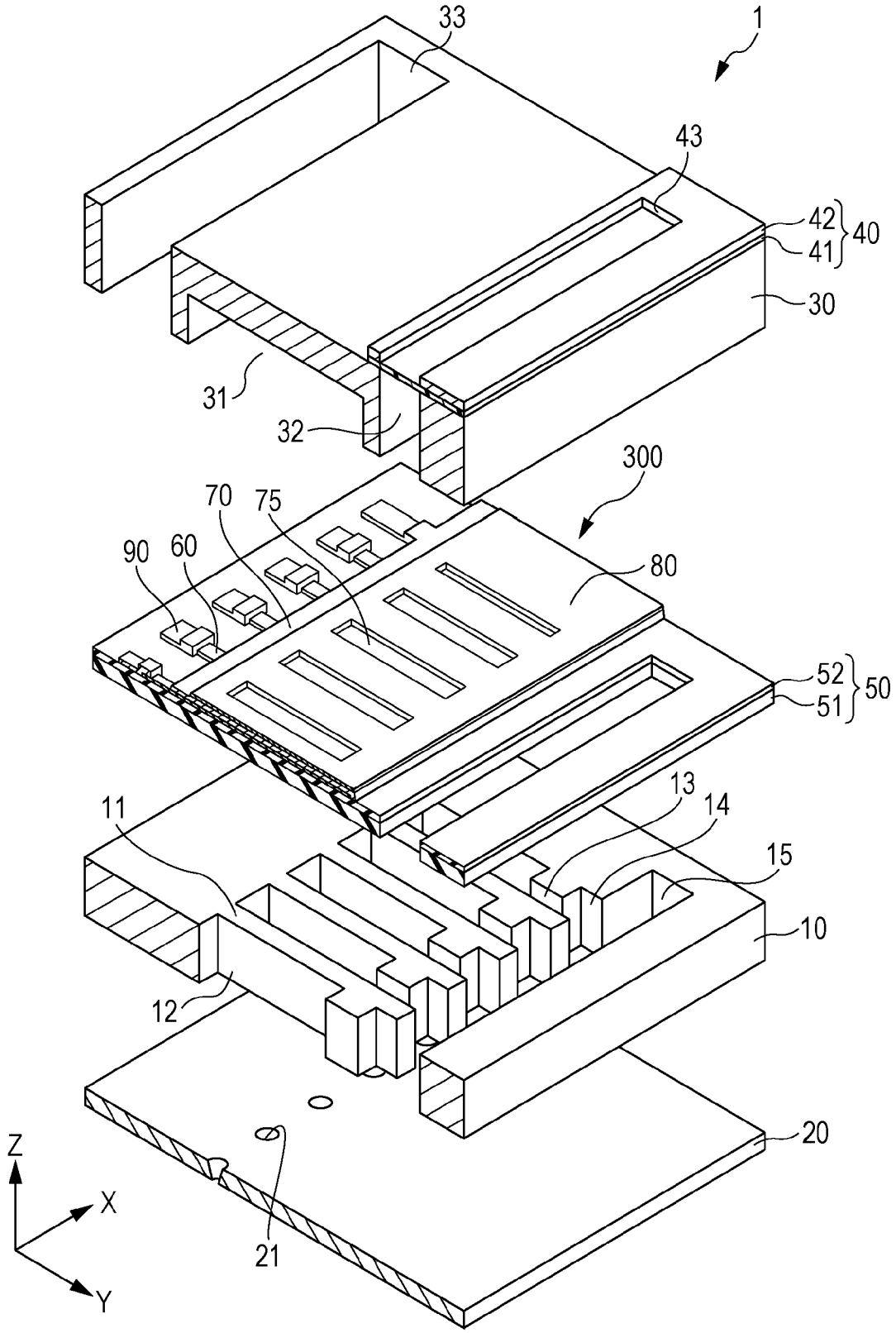
FIG. 2 is a exploded oblique view illustrating a recording head according to the first embodiment.
Figure 3A:
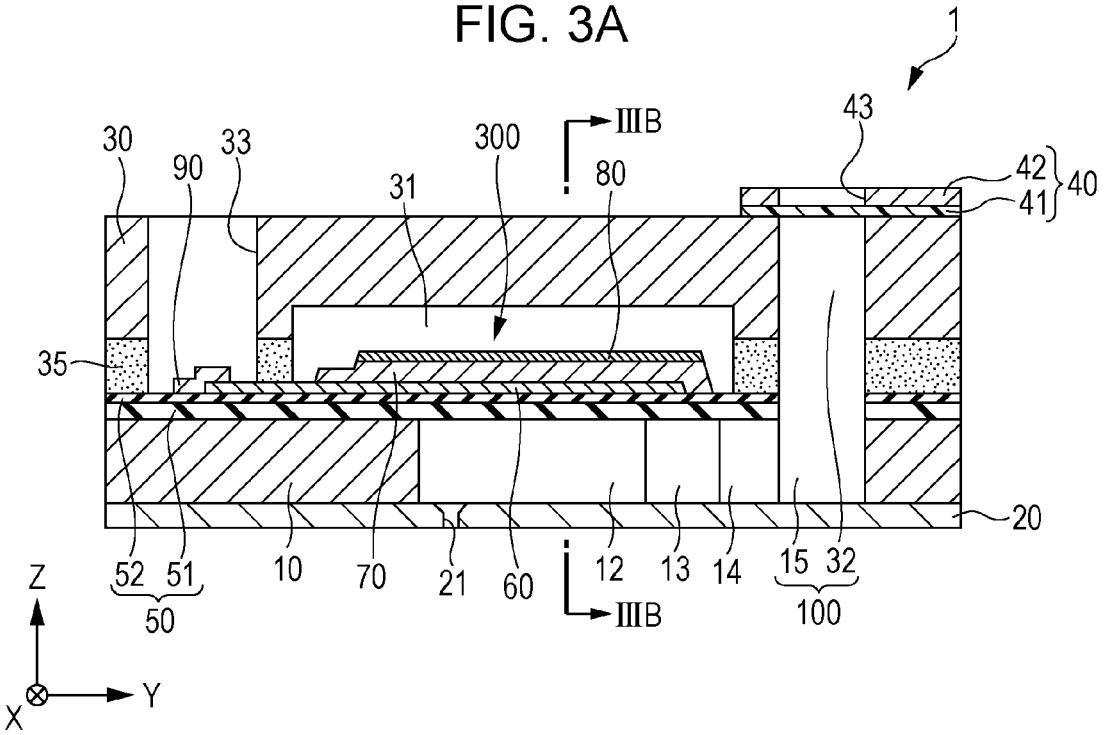
FIG. 3A is a plan view illustrating the recording head according to the first embodiment and FIG. 3B is a sectional view illustrating the recording head according to the first embodiment.
Figure 3B:
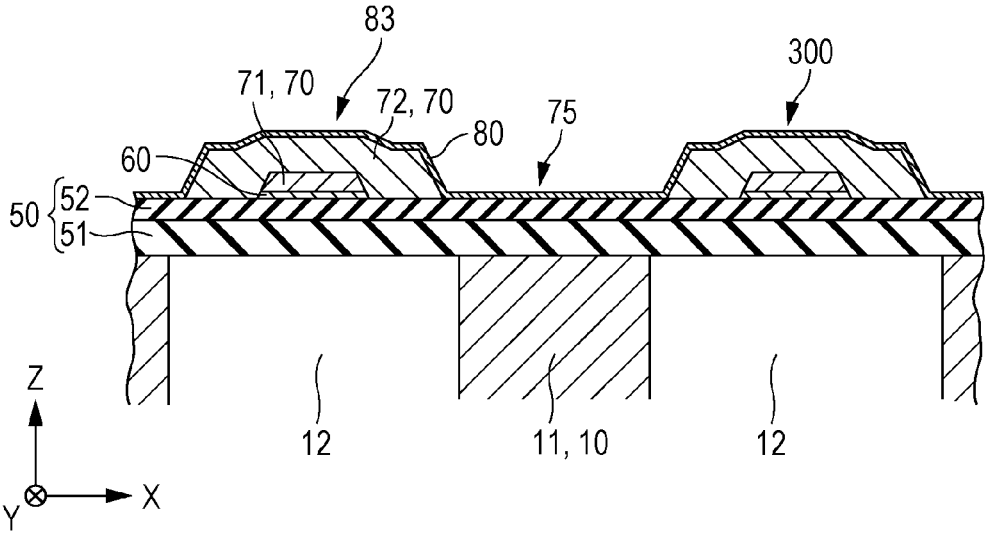

Hereinafter, a schematic configuration of the ink jet recording head as an example of the liquid ejecting head according to the first embodiment will be described appropriately with reference to drawings. FIG. 2 is a disassembled oblique view of the recording head according to the first embodiment. In addition, FIG. 3A is a plan view of the piezoelectric element of the flow channel forming substrate, and FIG. 3B is a sectional view taken along a line IIIB-IIIB of FIG. 3A.

As illustrated in the drawings, in a flow channel forming substrate 10, along a direction where a plurality of nozzle openings 21 discharging ink having same color are arranged, and pressure generating chambers 12 divided using a plurality of partition walls 11 are arranged. That is, a space constituting the pressure generating chamber 12 which communicates with the nozzle openings 21 is formed in the flow channel forming substrate 10. After that, an arranged direction of the pressure generating chamber 12 is referred to as a width direction or a first direction X, a thickness direction of a flow channel forming substrate 10 is referred to as a third direction Z, and a direction perpendicular to either of the first direction X or the third direction Z is referred to as a second direction Y. The "first direction" disclosed in Claims corresponds to the described above width direction or the first direction X (the arranged direction of the pressure generating chamber 12).

In one end portion of the second direction Y of the pressure generating chamber 12 of the flow channel forming substrate 10, an ink supplying passage 13 in which an opening area is reduced by narrowing one side of the pressure generating chamber 12 from the first direction X is partitioned from a communication passage 14 including the same width as the pressure generating chamber 12 in the first direction X by a plurality of the partition wall 11. A communication portion 15 constituting a part of a manifold 100 which is an ink chamber common to the pressure generating chamber 12 is formed in the outside of the communication passage 14 (an opposite side of the pressure generating chamber 12 in the second direction Y). That is, a liquid flow channel which is configured to have the pressure generating chamber 12, the ink supplying passage 13, the communication passage 14, and the communication portion 15 is formed in the flow channel forming substrate 10. The nozzle plate 20 in which the nozzle opening 21 communicating with each pressure generating chamber 12 is perforated is bonded to one surface of the flow channel forming substrate 10, that is, in a surface in which the liquid flow channel of the pressure generating chamber 12, or the like is opened, by an adhesive, a heat-welding film, or the like. The nozzle openings 21 are arranged on the nozzle plate 20 in the first direction X.

The vibration plate 50 is formed on one surface of a side of the flow channel forming substrate 10 opposite to the nozzle plate 20. Here, the vibration plate 50 is configured to have an elastic film 51 formed on a flow channel forming substrate 10 and an insulating film 52 formed on the elastic film 51. However, it is not limited thereto, and a film formed by making a part of the flow channel forming substrate 10 be thin can also be used as the elastic film. A first electrode 60, a piezoelectric layer 70, and a second electrode 80 are sequentially stacked on the insulating film 52, for example, through an adhesion layer (not illustrated) made of titanium, such that a piezoelectric element 300 is formed. However, the adhesion layer can be omitted.

In the first embodiment, a combination of both the piezoelectric element 300 and the vibration plate 50 displaced by driving the piezoelectric element 300 is referred to as an actuator apparatus. In addition, the vibration plate 50 and the first electrode 60 act as the vibration plate; however, it is not limited thereto. Only the first electrode 60 may act as the vibration plate without forming either or both of the elastic film 51 or the insulating film 52. In addition, the piezoelectric element 300 itself may also practically function as the vibration plate. In a case in which the first electrode 60 is directly formed on the flow channel forming substrate 10, it is preferable that the first electrode 60 is protected by an insulating protective film, or the like so that the first electrode 60 and the ink do not contact with each other. The flow channel forming substrate 10 and the vibration plate 50 are not limited to a separate body, and may be configured to be a single body.

A first electrode 60 constituting the piezoelectric element 300 is provided separately in every pressure generating chamber 12, and is independently configured in every active portion as a separated electrode. Moreover, in this specification, the active portion indicates a region which is sandwiched between the first electrode 60 and the second electrode 80 in the piezoelectric element 300.

The first electrode 60 is formed in which a width thereof is narrower than a width of the pressure generating chamber 12 in the first direction X of the pressure generating chamber 12. That is, the first electrode 60 is formed, in which the width of at least the first direction X is narrower than the space in a region corresponding to a space described above constituting the pressure generating chamber 12, along an opposite surface (a surface opposite to the flow channel forming substrate 10). In addition, both end portions of the first electrode 60 is formed up to the outside of the pressure generating chamber 12 in the second direction Y. Accordingly, the first electrode 60 may be formed, in which the width is wider than the space constituting the pressure generating chamber 12 in a direction other than the first direction X, for example, in the second direction Y. However, it is not limited to the above described example, and the first electrode 60 may be formed so that the end portion thereof is positioned inside than the space, even in the direction other than the first direction X. In the second direction Y, a lead electrode 90 is connected to one end portion of the first electrode 60 (an opposite side to the communication passage 14 in the second direction Y). A material constituting the first electrode 60 is not limited to any material as long as the material has conductivity, and for example, a noble metal such as platinum (Pt) or iridium (Ir) is suitably used as the material.

In the first direction X, the piezoelectric layer 70 is set to be wider than the first electrode 60 and narrower than the pressure generating chamber 12. That is, the piezoelectric layer 70 is stacked so as to overlap the first electrode 60 and at least a part of the vibration plate 50 in a region corresponding to the space constituting the pressure generating chamber 12. In addition, in the second direction Y, end portions of the nozzle opening 21 (left side end portion of FIG. 3B) of the piezoelectric layer 70 are positioned inside than an end portion of the first electrode 60, and the first electrode 60 becomes exposed. The lead electrode 90 described above is connected to an exposed part of the first electrode 60. Meanwhile, the ink supplying passage 13

(right side end portion of FIG. 3B) of the piezoelectric layer 70 is positioned in the outside of the end portion of the first electrode 60, and the end portion of the first electrode 60 is covered with the piezoelectric layer 70.

In such a piezoelectric element 300, in general, one electrode becomes a common electrode, and the other electrode becomes a separated electrode by patterning in every pressure generating chamber 12. In the first embodiment, the first electrode 60 becomes the separated electrode, and the second electrode 80 becomes the common electrode. The second electrode 80 is continuously formed throughout a plurality of the pressure generating chambers 12, and thus the second electrode 80 becomes the common electrode.

In the first embodiment, the piezoelectric element 300 is configured to have a first piezoelectric layer 71 which is patterned at the same time as the first electrode 60 and is positioned on the first electrode 60, and a second the piezoelectric layer 72 which covers the first piezoelectric layer 71 and the first electrode 60 at least in a width direction. In addition, a convex portion 83, which has a width wider than the first electrode 60 and is convex in an opposite direction of a vibration plate 50, is further provided on an upper surface of the second piezoelectric layer 72. The first piezoelectric layer 71 or the second piezoelectric layer 72 is formed in a predetermined process, and a boundary between the layers, for example, can be recognized by an image analysis using a scanning electron microscope. However, this boundary recognizing method is not limited to the above described examples.

The piezoelectric layer 70 is formed of a ferroelectric ceramic material showing electromechanical conversion action, which is provided on the first electrode 60, and can use a crystal film having a perovskite structure (perovskite type crystal) represented by a general formula $ABO_3$. For example, A contains platinum (Pb), and B contains at least either or both of zirconium (Zr) and titanium (Ti). That is, as the piezoelectric layer 70, for example, lead zirconate titanate (Pb (Zr, Ti) $O_3$:PZT), or the like can be used.

However, the material of the piezoelectric layer 70 is not limited to the above described materials, and for example, lead titanate ($PbTiO_3$), barium titanate ($BaTiO_3$), lithium niobate ($LiNbO_3$), lithium tantalate ($LiTaO_3$), sodium niobate ($NaNbO_2$), sodium tantalate ($NaTaO_2$), potassium niobate ($KNbO_3$), tantalum potassium acid ($KTaO_3$), bismuth sodium titanate ($(Bi_{1/2}Na_{1/2})\ TiO_3$), bismuth potassium titanate ($(Bi_{1/2}K_{1/2})\ TiO_3$), bismuth ferrate ($BiFeO_2$), strontium bismuth tantalate ($SrBi_2Ta_2O_9$), strontium bismuth niobate ($SrBi_2Nb_2O_9$), bismuth titanate ($Bi_4Ti_3O_{12}$), and a solid solution having at least any one of these as a component can be used. When a piezoelectric material not having lead is used, a load on the environment can be reduced.

A concave portion 75 corresponding to each partition wall 11 is formed on the piezoelectric layer 70. A width of the first direction X of the concave portion 75 is substantially equal to or wider than a width of the first direction of the partition wall 11. Accordingly, since rigidity of a part (so called an arm portion of the vibration plate 50) corresponding to an end portion of the second direction Y of the pressure generating chamber 12 of the vibration plate 50 is suppressed, the piezoelectric element 300 can be suitably displaced.

The second electrode 80 is stacked so as to overlap the piezoelectric layer 70 in an area corresponding to the space constituting the pressure generating chamber 12, in a surface side of the piezoelectric layer 70 opposite to the first electrode 60, and is formed as a common electrode common to each pressure generating chamber 12. A material of the second electrode 80, is not particularly limited as long as the material has conductivity, as the material of the first electrode 60, and for example, a novel metal such as platinum (Pt) or iridium (Ir) is suitably used. Based on a relationship in which the second electrode 80 is formed so as to overlap the second piezoelectric layer 72 having the described above convex portion 83, a convex portion based on a convex portion 83 of a second piezoelectric layer 72 is also formed on the upper surface of the second electrode 80.

In addition, on the flow channel forming substrate 10 on which the piezoelectric element 300 is provided, that is, on the vibration plate 50, the first electrode 60, and the lead electrode 90, a protection substrate 30, which includes a manifold portion 32 constituting at least a part of the manifold 100, is provided by bonding using an adhesive 35. In the first embodiment, the manifold portion 32 is formed throughout a width direction of the pressure generating chamber 12 by penetrating the protection substrate 30 in a thickness direction, and is provided with, as described above, the manifold 100 which is a common ink chamber to each pressure generating chamber 12 communicating with the communication portion 15 of the flow channel forming substrate 10. In addition, the communication portion 15 of the flow channel forming substrate 10 is divided in plural in every pressure generating chamber 12, and only the manifold portion 32 may be used as the manifold. Further, for example, only the pressure generating chamber 12 is formed on the flow channel forming substrate 10, and the ink supplying passage 13 communicating with the manifold and each pressure generating chamber 12 may be formed on the elastic film 51 and the insulating film 52 interposed between the flow channel forming substrate 10 and the protection substrate 30.

In the protection substrate 30, in a region facing the piezoelectric element 300, the piezoelectric element holding portion 31 including a space not inhibiting the movement of the piezoelectric element 300 is formed. Moreover, as long as the piezoelectric element holding portion 31 includes the space not inhibiting a movement of the piezoelectric element 300, the piezoelectric element holding portion 31 is usable, and the space may be sealed or not be sealed. In addition, in the protection substrate 30, a penetrating hole 33 penetrating the protection substrate 30 in a thickness direction is formed. An end portion of a lead electrode 90 drawn from the first electrode 60 of each piezoelectric element 300 is formed so as to be exposed in the penetrating hole 33.

On the protection substrate 30, a driving circuit (not illustrated) which functions as a signal processing portion is fixed. As the driving circuit, for example, a circuit substrate, a semiconductor integrated circuit (IC), or the like can be used. The driving circuit is connected to a printer controller (200 illustrated in FIG. 1). The driving circuit and the lead electrode 90 can be connected through a connecting wire made of a conductive wire such as a bonding wire which is inserted into the penetrating hole 33.

In addition, on the protection substrate 30, a compliance substrate 40 configured to have a sealing film 41 and a fixing plate 42 is bonded. The sealing film 41 is made of a material having low rigidity, and one surface of the manifold portion 32 is sealed by the sealing film 41. In addition, the fixing plate 42 can be formed of a hard material such as metal. Since a region facing the manifold 100 of the fixing plate 42 becomes the opening portion 43 which is entirely removed in the thickness direction, one surface of the manifold 100 is sealed with only the sealing film 41 having flexibility.

The recording head 1 of the first embodiment includes the flow channel forming substrate 10 in which the pressure generating chambers 12 communicating with the nozzle opening 21 are formed in plural in the width direction (first direction X), and the piezoelectric element 300, which is formed on a region corresponding to the pressure generating chamber 12 of one surface of the flow channel forming substrate 10, and is configured to have the first electrode 60, the piezoelectric layer 70 and the second electrode 80 by stacking. The first electrode 60 is respectively formed on the pressure generating chamber 12, and has a width having smaller than the pressure generating chamber 12 in the width direction. The piezoelectric layer 70 is stacked so as to overlap the first electrode 60 in a region corresponding to the pressure generating chamber 12, the second electrode 80 is continuously stacked in the width direction so as to overlap the piezoelectric layer 70.

Figure 4:
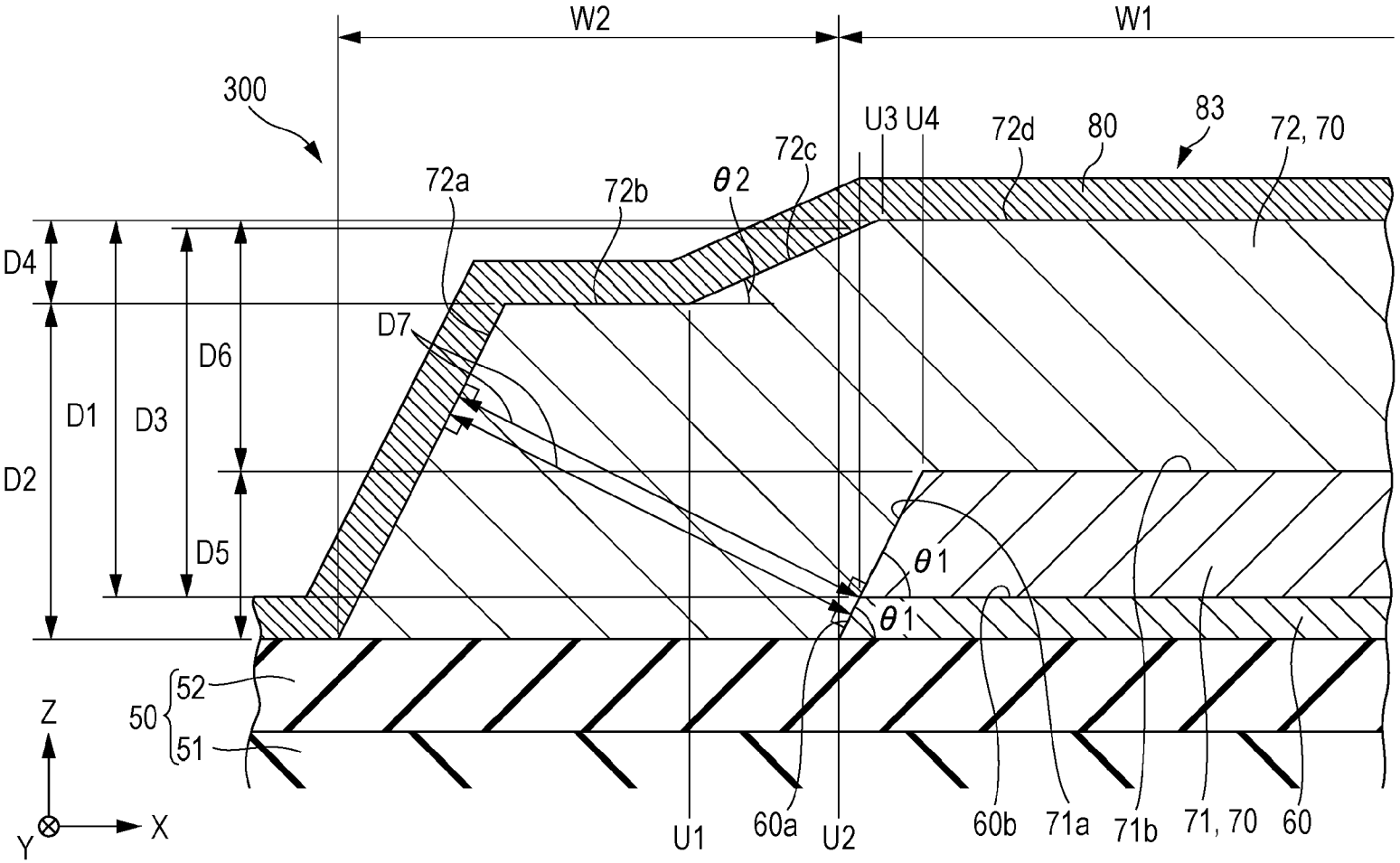
FIG. 4 is an enlarged sectional view illustrating the recording head according to the first embodiment.

Here, a configuration example of the piezoelectric element 300 which is mounted on the recording head 1 of the first embodiment will be described in detail. FIG. 4 is an enlarged view of FIG. 3B. In the drawings, D1 to D7 indicate a film thickness of the piezoelectric layer 70, and particularly, D1 to D6 indicate a film thickness of a third direction Z of the piezoelectric layer 70.

In the piezoelectric element 300, a thickness of a stacked direction of the piezoelectric element 300 (third direction Z illustrated in FIGS. 2 to 7, and the like) is a thickness of the piezoelectric layer 70, and a relationship between the first thickness (D1) of the piezoelectric layer 70 in a part (W1) positioned on the first electrode 60 and the first thickness (D2) of the piezoelectric layer 70 in a part (W2) positioned on the vibration plate 50 in the width direction further than the first electrode 60 satisfies a relationship of the first thickness (D1)>the second thickness (D2). Accordingly, as much as the first thickness (D1) is secured, electric field intensity generated between the electrodes can be suitably reduced by applying the driving voltage to the first electrode 60 or the second electrode 80. In addition, while the thickness of the first thickness (D1) is secured as such an appropriate thickness and the second thickness (D2) is not unnecessarily thick, excessive inhibiting of a displacement of the piezoelectric element 300 can be avoided.

That is, in the related art, in the recording head in which the lower electrode becomes the separated electrode and the upper electrode becomes the common electrode, in a manufacturing process thereof, an upper surface of the piezoelectric layer is generally flat, and even when the upper surface of the piezoelectric layer is convex as much as the lower electrode is formed, a thickness of a convex part becomes equal to the thickness of the lower electrode. Meanwhile, in terms of displacement properties, since a part of the second thickness (D2) disclosed in this specification becomes a load with respect to a displacement operation, the thinner the second thickness (D2), the better. However, unless the second thickness (D2) is made thin carefully, the first thickness (D1) also gets thin, such that there is a concern that the thickness of the first thickness (D1) becomes excessively thin, electric field intensity excessively increases, necessary rigidity is insufficient, or the like. For this reason, in the related art, the second thickness (D2) includes an extra space of the thickness. However, in the first embodiment, the piezoelectric element 300 is formed by a predetermined manufacturing process, a relationship of the first thickness (D1)>the second thickness (D2) is satisfied.

The first thickness (D1) is a thickness of the piezoelectric layer 70 of the center of a width direction of a part (W1) positioned on the first electrode 60.

Accordingly, a relationship of the first thickness (D1)>the second thickness (D2) is satisfied at least in the center of width direction, the electric field intensity generated by applying the driving voltage can be effectively reduced. However, the first thickness (D1) is not limited to the thickness of the piezoelectric layer 70 of the center of the width direction, and may be any thickness of the piezoelectric layer 70 at a position including at least the center of the width direction. In this case, a measured average value of a plurality of positions including the center of the width direction, or the like can be used. Accordingly, a surface which is a measuring point or a final point of the first thickness (D1) has a roughness, therefore, it is advantageous when the reliability is difficult to secure with only a measuring point of one point.

In addition, the first electrode 60 includes a side surface 60*a* which is inclined upwardly toward the center of the width direction and an upper surface 60*b* formed continuously to the side surface 60*a*. The first electrode 60 has 90% or more of a ratio (first thickness (D1)/third thickness (D3)) of the first thickness (D1) to the third thickness (D3) of the piezoelectric layer 70 on a boundary between the side surface 60*a* and upper surface 60*b* positioned in the width direction of the first electrode 60. Accordingly, the first thickness (D1) is suitably great by including an end portion of the width direction of the piezoelectric layer 70 of the part (W1) positioned on the first electrode 60.

Here, the piezoelectric layer 70 includes have a first side surface 72*a* inclined upwardly toward the center of the width direction and a first upper surface 72*b* formed continuously to the first side surface 72*a*. The piezoelectric layer 70 is configured to have the convex portion 83 which is greater than the first electrode 60 and is convex in an opposite direction of the vibration plate 50, on the first upper surface 72*b*. Specifically, the piezoelectric element 300 mounted on the recording head 1 of the first embodiment is configured to have the first piezoelectric layer 71 formed by patterning at the same time as the first electrode 60 and positioned on the first electrode 60 and the second piezoelectric layer 72 covering at least the first piezoelectric layer 71 and the first electrode 60 in the width direction. In addition, the convex portion 83 is configured to have a second side surface 72*c* inclined upwardly in the center of the width direction and a second upper surface 72*d* formed continuously to the second side surface 72*c*.

In other words, in the piezoelectric layer 70, the second piezoelectric layer 72, which covers at least the first piezoelectric layer 71 and the first electrode 60 in the width direction, is configured to have the first side surface 72*a* inclined upwardly toward the center of the width direction, the first upper surface 72*b* formed continuously to the first side surface 72*a*, the second side surface 72*c* inclined further upwardly toward the center of the width direction from the first upper surface 72*b*, and the second upper surface 72*d* formed continuously to the second side surface 72*c*. A convex portion 83 is configured to include the second side surface 72*c* and the convex portion 83 formed by the second side surface 72*c* is prepared, and a relationship of the first thickness (D1)>the second thickness (D2) is satisfied.

The first piezoelectric layer 71 is formed of, for example, one layer of the piezoelectric film. A predetermined acute angle θ1 is formed between the side surface 60*a* of the first electrode 60 and the vibration plate 50, and the predetermined acute angle θ1 that is the same as the above described angle is formed between the side surface 71*a* of the first piezoelectric layer 71 and the vibration plate 50. That is, by patterning at the same time as the first electrode 60, the side surface 71*a* of the first piezoelectric layer 71 is formed continuously and in parallel with respect to the side surface 60*a* of the first electrode 60.

In addition, the second piezoelectric layer 72 is formed of, for example, plural layers of the piezoelectric films. The second side surface 72*c*, which is further inclined upwardly toward the center of the width direction from the first upper surface 72*b* of the second piezoelectric layer 72, has forms a predetermined acute angle θ2 with the vibration plate 50.

The acute angle θ2 formed between the second side surface 72*c* of the second piezoelectric layer 72 and the vibration plate 50 is smaller than the acute angle θ1 formed between the side surface 60*a* of the first electrode 60, or the like and the vibration plate 50, and the second side surface 72*c* of the second piezoelectric layer 72 gently rises from the vibration plate 50 more than the side surface 60*a* of the first electrode 60. In such an aspect, in order to realize the above described thickness relationship, a rise-fall start position U1 of the second side surface 72*c* of the second piezoelectric layer 72 is formed in the outside from a rise-fall start position U2 of the side surface 60*a* of the first electrode 60.

In addition, a fourth thickness (D4) of the convex portion 83 in the second piezoelectric layer 72 and a fifth thickness (D5) of the first electrode 60 and the first piezoelectric layer 71 satisfy a relationship of the fifth thickness (D5)>the fourth thickness (D4). Accordingly, the fourth thickness (D4) can be prevented from being excessively increased, as a result, while satisfying the relationship of the first thickness (D1)>the second thickness (D2), the first thickness (D1) can be prevented from being excessively increased.

In addition, a sixth thickness (D6) of the second piezoelectric layer 72 from an upper surface of the first piezoelectric layer 71 to the second upper surface 72*d* of the convex portion 83 of the second piezoelectric layer 72 and the second thickness (D2) satisfies a relationship of the second thickness (D2)>the sixth thickness (D6). Accordingly, a relationship of the first thickness (D1)>the second thickness (D2)>the sixth thickness (D6) is satisfied, it is possible to prevent the second thickness (D2) from being excessively thin and prevent the electric field intensity from being unnecessarily generated. In the first embodiment, since a boundary position U4 of the side surface 71*a* and an upper surface 71*b* of the first piezoelectric layer 71 is positioned in the center of the width direction than a boundary position U3 of the first side surface 72*a* and the first upper surface 72*b* of the second piezoelectric layer 72, and on the first electrode 60, the sixth thickness (D6) of the second piezoelectric layer 72 positioned on the upper surface 71*b* of the first piezoelectric layer 71 is secured, therefore, a relationship of the first thickness (D1)>the second thickness (D2) is reliably satisfied.

When the first thickness (D1) is calculated, even in the piezoelectric layer 70 of the part (W1) positioned on the first electrode 60, according to the position, the upper end side is the second side surface 72*c* of the second piezoelectric layer 72, in this case, it is difficult to suitably calculate the first thickness (D1). In the same manner, when the second thickness (D2) is calculated, even in the piezoelectric layer 70 of the part (W2) positioned on the vibration plate 50 in the width direction side than the first electrode 60, according to the position, the upper end side thereof is the first side surface 72*a* of the second piezoelectric layer 72, in this case, it is difficult to suitably calculate the second thickness (D2). In these cases, the first thickness (D1) may be a distance between an upper surface 60*b* of the first electrode 60 and the second upper surface 72*d* of the convex portion 83 of the second piezoelectric layer 72, and the second thickness (D2) may be a distance between the vibration plate 50 and the first upper surface 72*b* of the second piezoelectric layer 72. As a result, the first thickness (D1) and the second thickness (D2) can be suitably calculated.

Such a thickness range, for example, will be described as follow. That is, the first thickness (D1) can be set to 700 nm to 5000 nm, and the second thickness (D2) can be set to 600 nm to 5000 nm. In addition, the thickness of the first electrode 60 can be set to 50 nm to 250 nm, and the thickness of the first piezoelectric layer 71 can be set to 100 nm to 400 nm.

Incidentally, the first side surface 72*a* of the second piezoelectric layer 72 forms the same acute angle θ1 with respect to the vibration plate 50. Accordingly, with respect to the side surface 60*a* of the first electrode 60 and the side surface 71*a* of the first piezoelectric layer 71 which are parallel to each other, the first side surface 72*a* of the second piezoelectric layer 72 is also positioned in parallel. In addition, a normal line length of the side surface 60*a* of the first electrode 60, the side surface 71*a* of the first piezoelectric layer 71, and the first side surface 72*a* of the second piezoelectric layer 72 is referred to as a seventh thickness (D7), and the seventh thickness (D7)>the first thickness (D1). Accordingly, in an end portion of the width direction of the second piezoelectric layer 72, a state in which the second piezoelectric layer 72 is excessively thin can be avoid, and it is possible to prevent the first electrode 60 and the second electrode 80 from being adjacent to each other and prevent generation of the excessive electric field intensity.

Hitherto, the configuration of the piezoelectric element 300 of the first embodiment has been described in detail; however, the configuration thereof is not limited to the above described example, and in a range in which a gist of the invention is not changed, when a relationship of the first thickness (D1)>the second thickness (D2) is satisfied, and preferably, when the relationship is the first thickness (D1)>the second thickness (D2)>the third thickness (D3), it is possible to change a geometric relationship of each side or a rise-fall position of the side surface.

Figure 5:
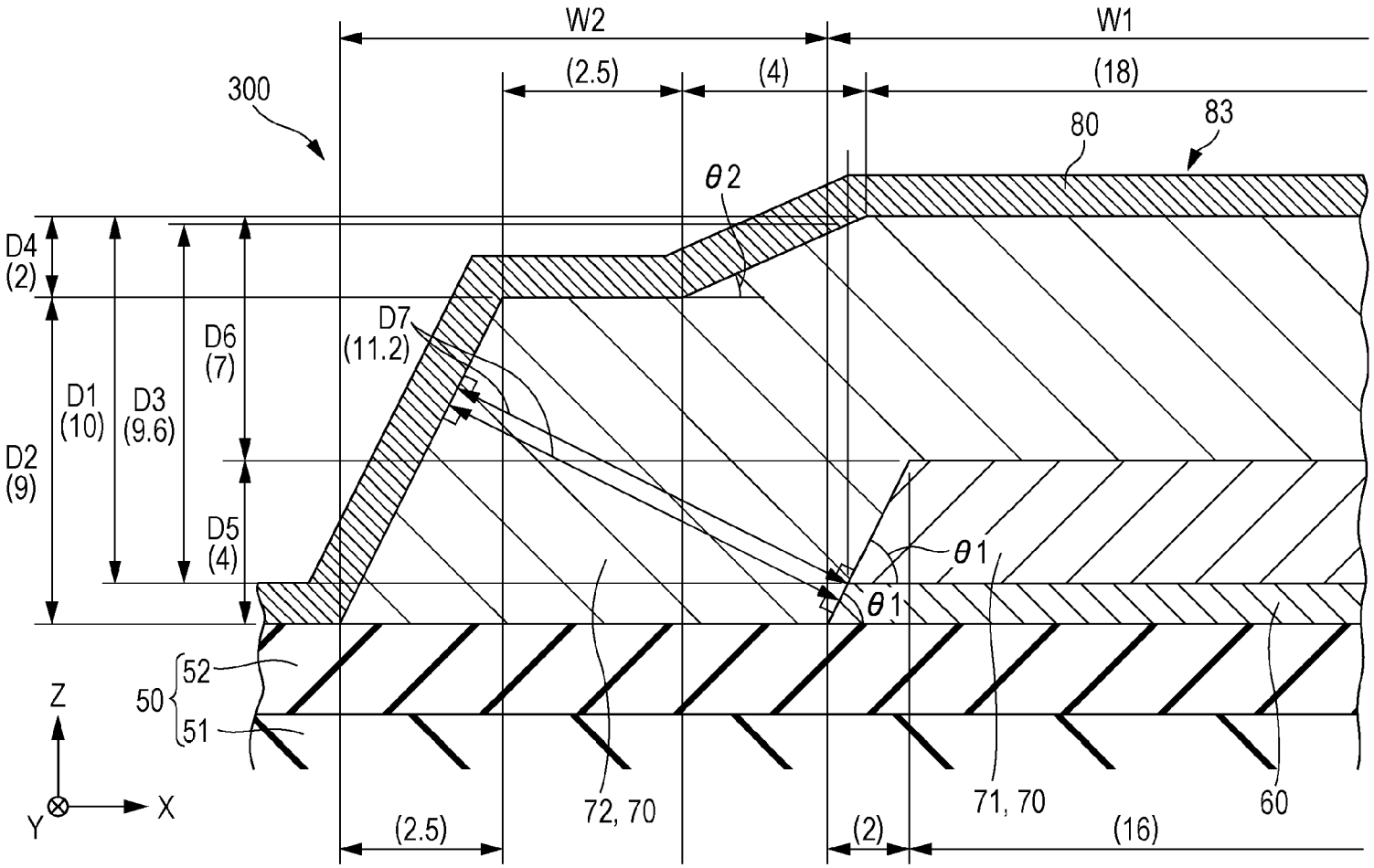
FIG. 5 is an enlarged sectional view illustrating the recording head according to the first embodiment.

FIG. 5 is a view illustrating an example of a ratio of a length relationship of each portion, for realizing the piezoelectric element 300 having such a thickness relationship. Moreover, FIG. 5 corresponds to FIG. 4, and an example of a ratio of a length of each portion is illustrated by an arrow range and a numeral value.

As illustrated in the drawings, regarding the thickness direction (third direction Z), the first thickness (D1) can be set to substantially 10, the second thickness (D2) can be set to substantially 9, the third thickness (D3) can be set to substantially 9.6, the fourth thickness (D4) can be set to substantially 2, the fifth thickness (D5) can be set to substantially 4, and the sixth thickness (D6) can be set to substantially 7.

In addition, when the first thickness (D1) is set to substantially 10, in regard to the width direction (first direction X), it is possible that a length in which the side surface (side surface 60*a* of FIG. 4) of the first electrode 60 and the side surface (side surface 71*a* of FIG. 4) of the first piezoelectric layer 71 are projected in a direction parallel to the first direction X is set to substantially 2, a length in which the first side surface (first side surface 72*a* of FIG. 4) of the second piezoelectric layer 72 is projected in a direction parallel to the first direction X is set to substantially 2.5, a length of the first upper surface (first upper surface 72*b* of FIG. 4) of the second piezoelectric layer 72 is set to substantially 2.5, a length in which the second side surface (second side surface 72*c* of FIG. 4) of the second piezoelectric layer 72 is projected in a direction parallel to the first direction X is set to substantially 4, and a length of the second upper surface (second upper surface 72*d* of FIG. 4) of the second piezoelectric layer 72 is set to substantially 18. Moreover, it is possible that the seventh thickness (D7), which is the normal line length of the side surface 60*a* of the first electrode 60 and the side surface 71*a* of the first piezoelectric layer 71, and the first side surface 72*a* of the second piezoelectric layer 72, is set to substantially 11.2.

Figure 6:
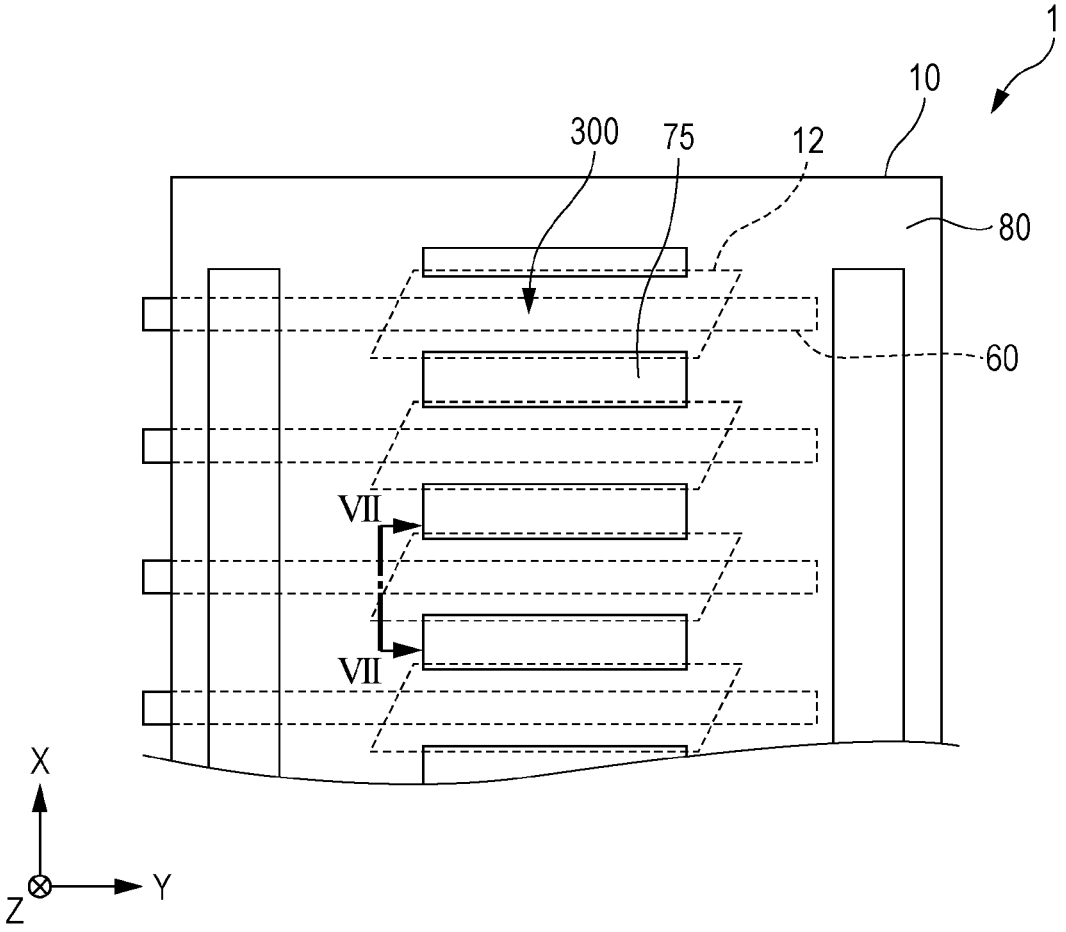
FIG. 6 is a plan view schematically illustrating the recording head according to the first embodiment.

Hitherto, an aspect of the piezoelectric element 300 described in detail with reference to FIG. 4, and FIG. 5 shows that the concave portions 75 corresponding to each partition wall 11 of in the recording head 1 exists on both sides thereof in the width direction. Meanwhile, even in a position where the concave portions 75 do not exist on both sides thereof in the width direction, the thickness relationship can be realized. FIG. 6 is a plan view schematically illustrating the piezoelectric element 300 of the flow channel forming substrate 10 of the recording head 1. As described with VII-VII line, even in a position over the concave portion 75 in the second direction Y, the thickness relationship is satisfied.

Figure 7:
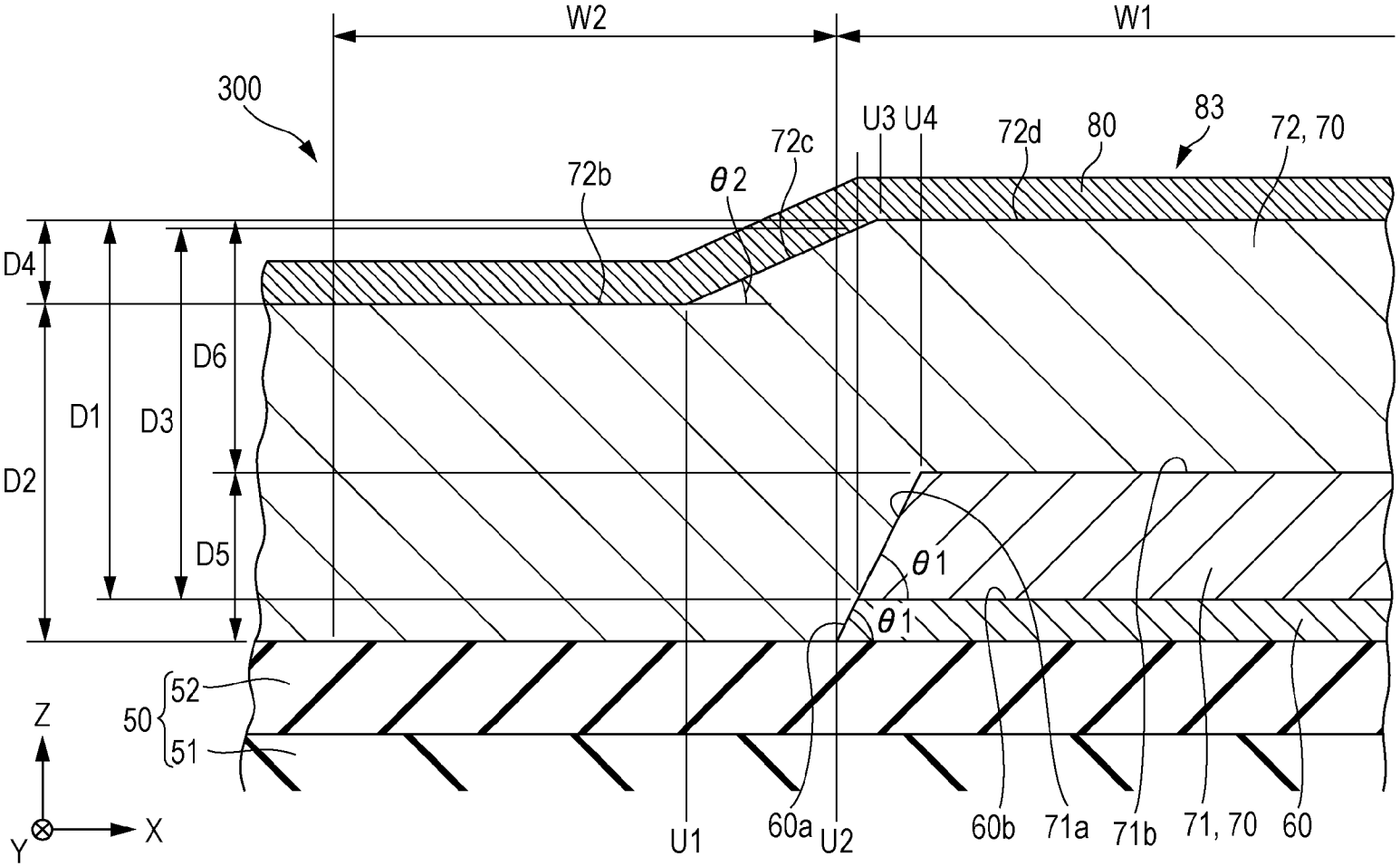
FIG. 7 is an enlarged sectional view illustrating the recording head according to the first embodiment.

FIG. 7 is a sectional view taken along the VII-VII line of FIG. 6. Comparing to the examples of FIG. 4 and FIG. 5, the side surface (first side surface 72*a* illustrated in FIG. 4) of the second piezoelectric layer 72 is not formed as the concave portion 75 does not exist on the both sides in the width direction, as a result, it is difficult to think of the seventh thickness (D7) which is the normal line length. However, even in an aspect illustrated in FIG. 7, it is possible to satisfy the relationship of the first thickness (D1)>the second thickness (D2), preferably the relationship of the first thickness (D1)>the second thickness (D2)>the third thickness (D3), accordingly, both securing reliability and excellent displacement properties can be achieved.

Subsequently, a manufacturing method of the recording head in the first embodiment will be described. FIG. 8A to FIG. 11 are a sectional view illustrating the manufacturing method of the recording head.

Figure 8A:
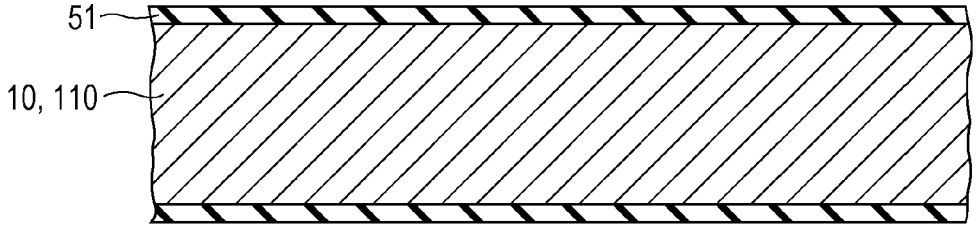
FIGS. 8A to 8C are sectional views illustrating a manufacturing method of the recording head according to the first embodiment.

As illustrated in FIG. 8A, an elastic film 51 is formed on a surface of a wafer 110 for the flow channel forming substrate, which is a silicon wafer. In the first embodiment, the elastic film 51 made of silicon dioxide is formed by performing a thermal oxidation on the wafer 110 for the flow channel forming substrate. Of course, a material of the elastic film 51 is not limited to the silicon dioxide, and may be a silicon nitride film, a polysilicon film, an organic film (polyimide, parylene, or the like), or the like. A forming method of the elastic film 51 is not limited to the thermal oxidation, and the elastic film 51 may be formed by a sputtering method, a CVD method, a spin coating method, or the like.

Figure 8B:
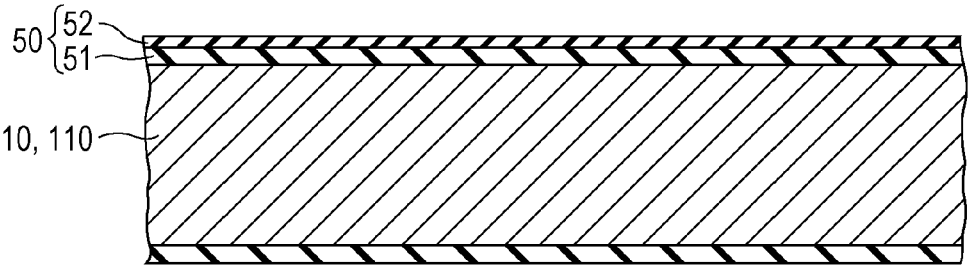

Next, as illustrated in FIG. 8B, the insulating film 52 made of zirconium oxide is formed on the elastic film 51. Of course, a material of the insulating film 52 is not limited to the zirconium oxide, and may be made of titanium oxide ($TiO_2$), aluminum oxide ($Al_2O_3$), hafnium oxide ($HfO_2$), magnesium oxide (MgO), lanthanum aluminate ($LaAlO_3$), or the like. Examples of a manufacturing method of the insulating film 52 include a sputtering method, a CVD method, an evaporation method, or the like. In the first embodiment, the vibration plate 50 is formed by the elastic film 51 and the insulating film 52; however, as the vibration plate 50, only one of the elastic film 51 and the insulating film 52 may be formed.

Figure 8C:
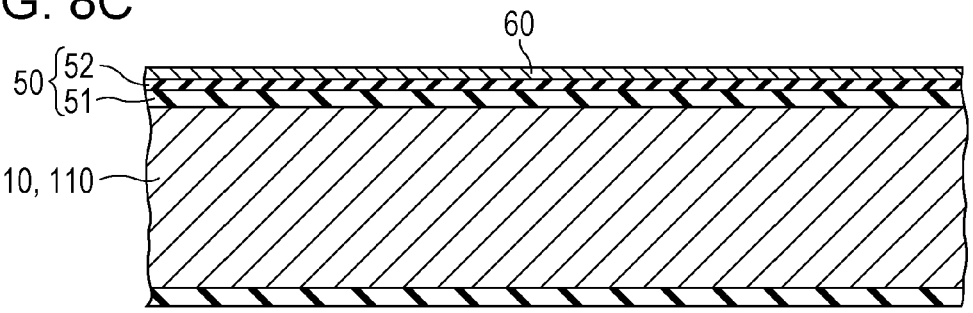

Next, as illustrated in FIG. 8C, the first electrode 60 is formed on the entire surface on the vibration plate 50. A material of the first electrode 60 is not particularly limited; however, a metal such as platinum or iridium, which does not lose conductivity even at high temperatures, conductive oxide such as iridium oxide or lanthanum nickel oxide, and stacked materials of these materials are suitably used. In addition, the first electrode 60 can be formed by, for example, a vapor phase film formation such as a sputtering method or a PVD method (physical vapor deposition), a laser ablation method, or a liquid phase film formation such as a spin coating method. In addition, an adhesion layer may be used between the conductive material and the vibration plate 50 for securing adhesion force. In the first embodiment, as the adhesion layer which is not illustrated, titanium is used. Moreover, as the adhesion layer, zirconium, titanium, titanium oxide, or the like can be used. A film formation of the adhesion layer is the same as that of an electrode material.

Subsequently, in the first embodiment, the piezoelectric layer 70 made of lead zirconate titanate (PZT) is formed. Here, in the first embodiment, the piezoelectric layer 70 is formed by a so called liquid phases method in which a so called coating solution obtained by dissolving and dispersing metal complex in a solvent is gelled by coating and drying and is further calcinated at high temperatures so that the piezoelectric layer 70 made of a metal oxide is obtained.

An example of the liquid phase method includes a sol gel method, a metal organic deposition (MOD) method, or the like; however, it is not limited to the above described example. According to the liquid phase method, the piezoelectric layer 70 which satisfies a predetermined thickness relationship can be suitably obtained using a flow of the coating solution after coating. However, a manufacturing method of the piezoelectric layer 70 is not limited to the liquid phase method, and for example, a physical vapor deposition (PVD) method such as a sputtering method, a laser ablation method may be used. When the piezoelectric layer 70 is formed by a method other than the liquid phase method, the piezoelectric layer 70 may be processed so as to satisfy the predetermined thickness relationship as needed. Of course, a process in which the piezoelectric layer 70 is processed in a predetermined shape by the liquid phase method can be performed.

Figure 9A:
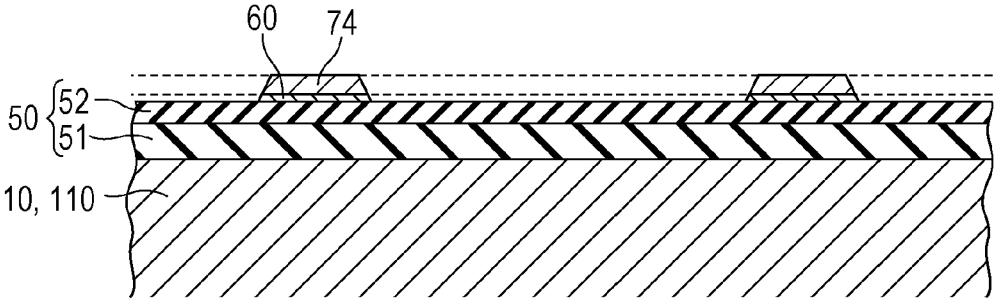
FIGS. 9A to 9C are sectional views illustrating the manufacturing method of the recording head according to the first embodiment.

In the first embodiment, using a predetermined coating solution, the piezoelectric films 74 are stacked at relatively small number of stacked layers so that the piezoelectric layer 70 is formed. Specifically, as illustrated in FIG. 9A, the first electrode 60 and the piezoelectric film 74 are patterned at the same time on a step where a first layer of the piezoelectric film 74 is formed on the first electrode 60. Moreover, the patterning of the first electrode 60 and the piezoelectric film 74, for example, can be performed by dry etching such as reactive ion etching (RIE) or ion milling.

A forming method of the piezoelectric film 74 is described as follow. That is, the coating solution including the metal complex is applied on the wafer 110 for the flow channel forming substrate on which the first electrode 60 is formed (coating process). Next, the piezoelectric precursor film is heated to a predetermined high temperature and dried for a certain time (drying process). Subsequently, the dried piezoelectric precursor film is heated to the predetermined temperature and is maintained for a certain time so as to be degreased (degreasing process). Subsequently, the piezoelectric precursor film is heated to the predetermined temperature and is maintained for a certain time so as to be crystallized, such that the piezoelectric film 74 is formed (calcination process). Moreover, as a heating apparatus using such a drying process, a degreasing process, and a calcination process, for example, a hot plate, a RTP apparatus which performs heating by irradiating using an infrared lamp, or the like can be used.

Figure 9B:
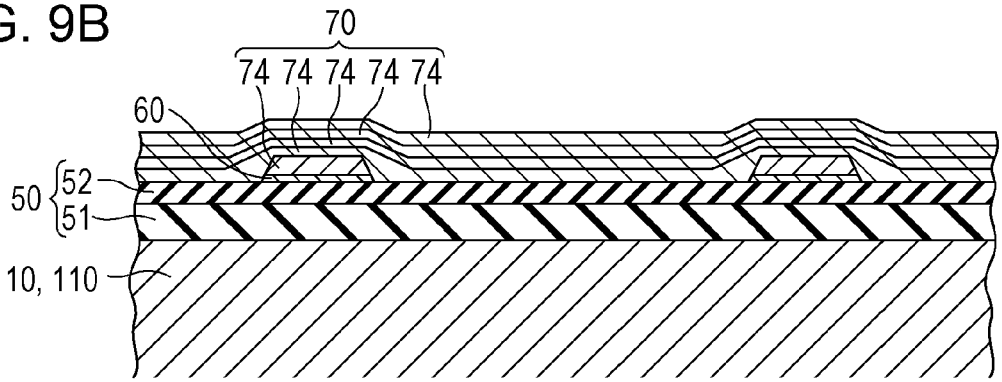

After that, as illustrated in FIG. 9B, the piezoelectric layer 70 formed of the plurality of layers of piezoelectric films 74 is formed by stacking the piezoelectric films 74 of the second and the subsequent layers. In addition, the piezoelectric films 74*s* of the second and the subsequent layers are formed continuously on the vibration plate 50, on the side surface of the first electrode 60 and the first layer of the piezoelectric film 74, and on an upper surface of the first layer of the piezoelectric film 74. In the first embodiment, the piezoelectric layer 70 is formed to have a total of five layers of the piezoelectric films 74; however, it is not limited to the above described example, and as long as piezoelectric layer 70 is manufactured to satisfy the predetermined thickness relationship, the piezoelectric layer is usable.

Here, in the first embodiment, the piezoelectric films 74 of the second and the subsequent layers are coated to be in a relatively thick form using the coating solution which has a low viscosity compared to the related art. As a result, the number of performing the coating process to the degreasing process, or the number of calcinations is significantly reduced. As such a coating solution having low viscosity, for example, a range of viscosity is substantially 4.0 MPa to 9.0 MPa, and preferably is substantially 5.5 MPa to 7.5 MPa.

Figure 9C:
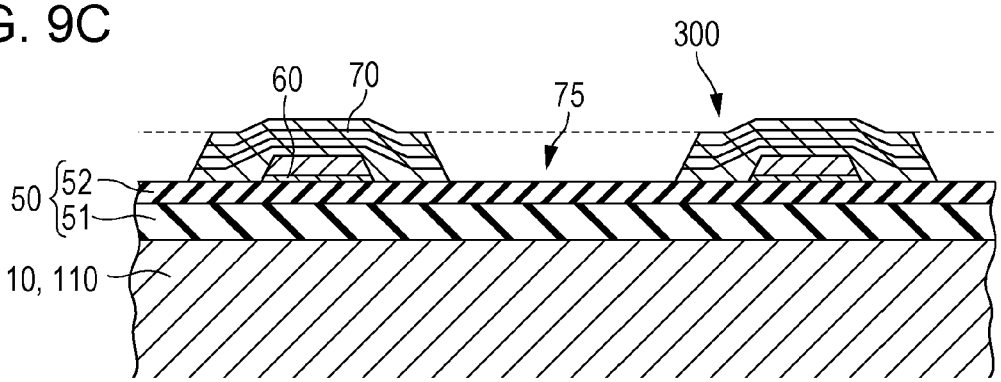

Subsequently, as illustrated in FIG. 9C, the concave portion 75, or the like is formed by patterning the piezoelectric layer 70. In the first embodiment, a mask (not illustrated) in a predetermined shape is formed on the piezoelectric layer 70, and the piezoelectric layer 70 is etched through the mask and is patterned by a so called photolithography. Moreover, as patterning of the piezoelectric layer 70, for example, a drying etching such as a reactive an ion etching or an ion milling, or a wet etching using an etching solution may be used.

Figure 10A:
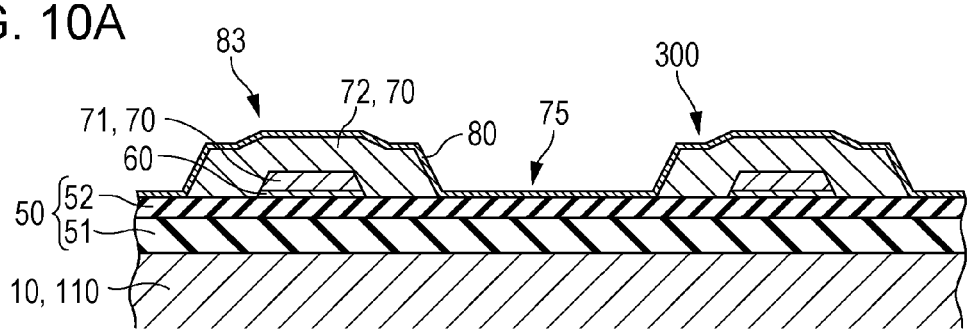
FIGS. 10A to 10C are sectional views illustrating the manufacturing method of the recording head according to the first embodiment.

Subsequently, as illustrated in FIG. 10A, the second electrode 80 is formed and patterned at the same time, throughout on one surface side of the wafer 110 for the flow channel forming substrate (a surface side on which the piezoelectric layer 70 is formed), on the side surface of the piezoelectric layer 70 which is patterned, on the first electrode 60, and throughout on the vibration plate 50. While the second electrode 80 is formed even on the vibration plate 50 in between the width direction of each piezoelectric element 300. Moreover, in the first embodiment, after patterning the piezoelectric layer 70, the second electrode 80 is formed and is patterned; however, it is not particularly limited thereto, after the second electrode 80 is formed before patterning the piezoelectric layer 70, patterning may be performed on the second electrode 80 and the piezoelectric layer 70.

Figure 10B:
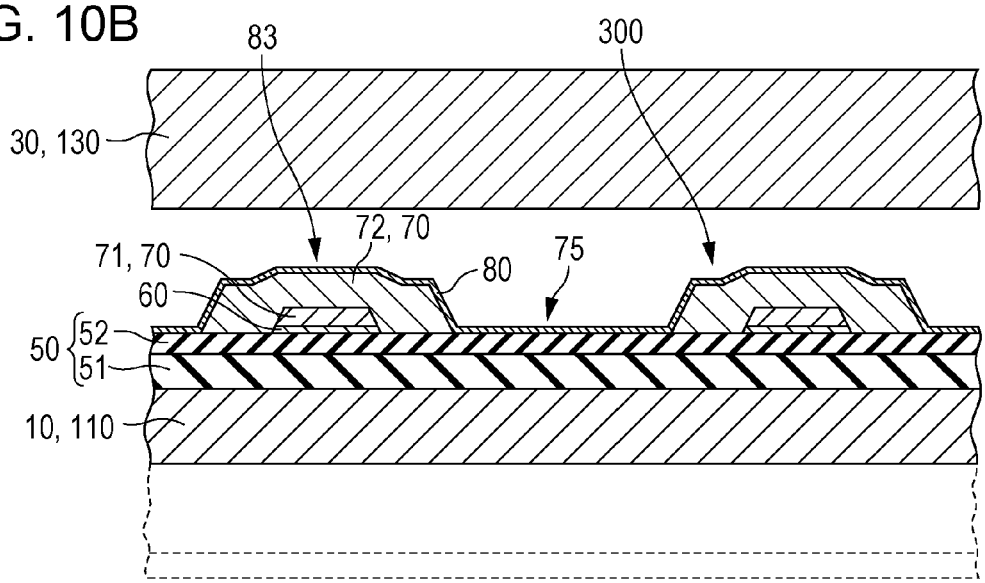
Figure 10C:
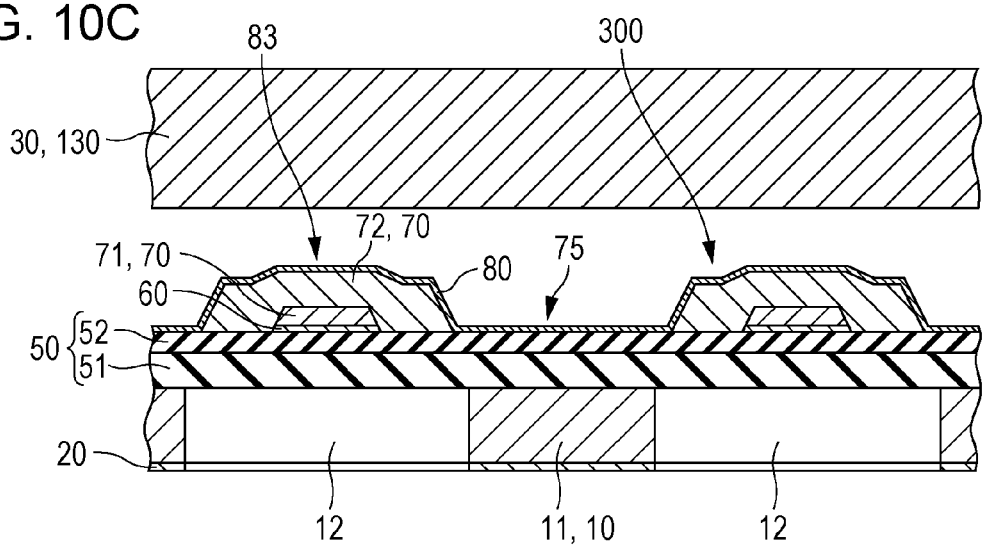

Subsequently, the lead electrode 90 is formed and patterned into a predetermined shape. In addition, after a wafer 130 for the protection substrate made of a plurality of the protection substrates 30 which is a silicon wafer is bonded to the piezoelectric element 300 of the wafer 110 for the flow channel forming substrate through an adhesive 35, as illustrated in FIG. 10B, the wafer 110 for the flow channel forming substrate is reduced as a predetermined thickness. Next, the mask film is newly formed and patterning into a predetermined shape on the wafer 110 for the flow channel forming substrate. In addition, as illustrated in FIG. 10C, the wafer 110 for the flow channel forming substrate is subjected to anisotropic etching (wet etching) through the mask film using an alkaline solution such as KOH, such that the pressure generating chamber 12, or the like corresponding to the piezoelectric element 300 is formed.

After that, unnecessary parts of outer peripheral edge portions of the wafer 110 for the flow channel forming substrate and the wafer 130 for the protection substrate are removed by cutting, for example, using a dicing, or the like. In addition, the nozzle plate 20 in which the nozzle opening 21 is perforated is bonded on a surface of the wafer 110 for the flow channel forming substrate opposite to the wafer 130 for the protection substrate, and the compliance substrate 40 is bonded to the wafer 130 for the protection substrate, and then the wafer 110 for the flow channel forming substrate is divided into one chip size of the flow channel forming substrate 10, or the like as illustrated in FIG. 2, such that the recording head 1 of the first embodiment is formed.

EXAMPLES

Hereinafter, examples will be described, and the invention will be described in detail. Moreover, the invention is not limited to the examples to be described below.

Example 1

When the piezoelectric layer 70 is formed by the sol gel method, a coating solution [1] having a relatively low viscosity is used. In the sol gel method, the coating process to the calcinations process are respectively performed one time, so that the piezoelectric film 74 which becomes the first piezoelectric layer 71 is formed to be 180 nm. In addition, a cycle in which the coating process to the calcinations process are performed one time is repeated five times, so that five layers of the piezoelectric films 74 of which a film is 340 nm are formed. The piezoelectric element 300, which is formed of total six layers of the piezoelectric films 74 and has the above described thickness relationship, is obtained, and thus, the liquid ejecting head is manufactured so as to include the piezoelectric element 300.

Comparative Example 1

When the piezoelectric layer 70 is formed by the sol gel method, a coating solution [2] of the related art having relatively high viscosity is used. In the sol gel method, the coating process to the calcinations process are respectively performed one time, so that the piezoelectric film 74 which becomes the first piezoelectric layer is formed to be 170 nm. In addition, a cycle in which the coating process to the degreasing process are performed three times and the calcinations process is performed one time is repeated three times, a cycle in which the coating process to the degreasing process are performed two times and the calcination process is performed one time is repeated one time, and thus, 11 layers of the piezoelectric films 74 of which a film is 160 nm are formed. The piezoelectric element formed of a total 12 layers of the piezoelectric films 74 is obtained, and thus, the liquid ejecting head is manufactured so as to include the piezoelectric element.

Compositions of the sol, configurations for forming the piezoelectric element, thicknesses, and the like are illustrated in Table 1.

TABLE 1

| | Example 1 | Comparative Example 1 |
|---|---|---|
| Coating Solution Type | coating solution [1] (AA sol) | coating solution [2] (NM sol) |

TABLE 1-continued

| | | Example 1 | Comparative Example 1 |
|---|---|---|---|
| Coating Solution Viscosity | | 6.5 MPa | 14.9 MPa |
| Solvent | | water, acetic acid | butoxyethanol |
| Coating Condition | Rotation Number | low | high |
| | Rotation Time | short | long |
| PZT Coating Time number | First Piezoelectric Layer | one time | one time |
| | Second Piezoelectric Layer | five times | 3 × 4 = 12 times |
| PZT calcination Time number | First Piezoelectric Layer | one time | one time |
| | Second Piezoelectric Layer | five times | four times |
| Second Thickness (D2) | | substantially 1100 nm | substantially 1380 nm |

As recognized from Table 1, in Example 1, by the coating solution [1] having relatively low viscosity, even when repeating of the coating process to the calcinations process is significantly reduced, a thickness in a normal use range can be obtained. When reducing coating times, it is predictable that cost is reduced. In addition, when the coating solution [1] is used, a desired piezoelectric element 300 can be obtained without thin coating or multilayer-coating using the coating solution having relatively high viscosity, a liquid ejecting head, a liquid ejecting apparatus, and a piezoelectric device have excellent properties of preventing crack generation and a uniformity of film thickness.

Another Embodiment

Hitherto, the one embodiment of the invention is described; however, a basic configuration of the invention is not limited thereto. For example, in the above described embodiment, as the flow channel forming substrate 10, a silicon single crystal substrate is exemplified; however, it is not particularly limited thereto, and for example, a SOI substrate or a material such as a glass may be used. The space constituting the pressure generating chamber 12 provided on the flow channel forming substrate 10 is not limited to a plural spaces; however, it may be a singular space according to an application of a device, or the like.

Figure 11:
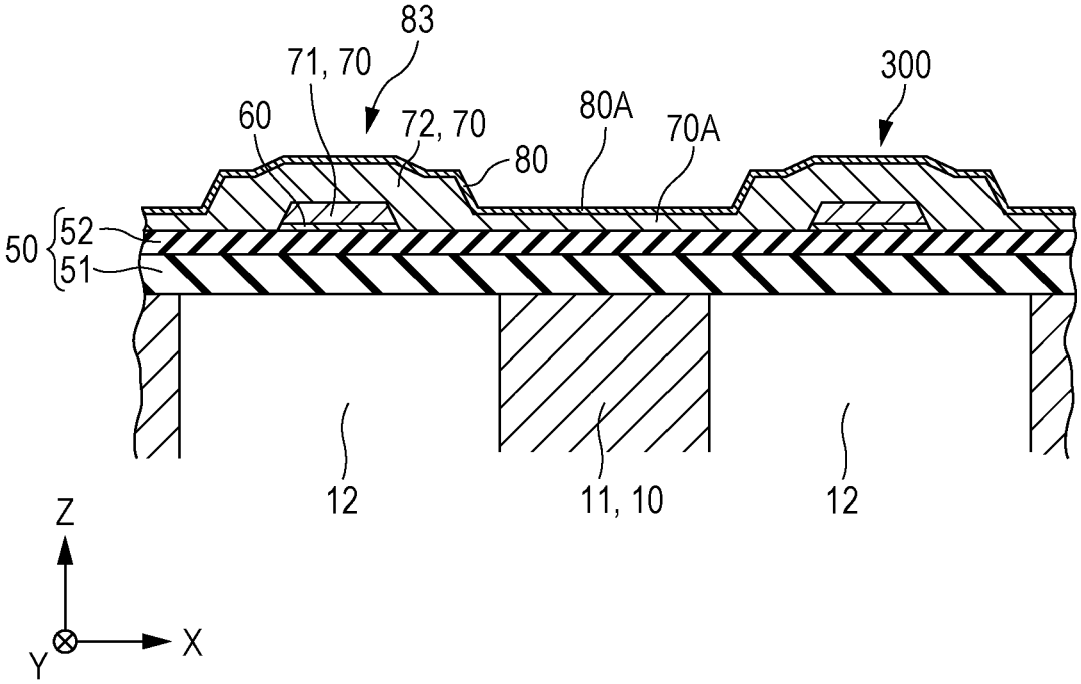
FIG. 11 is a sectional view describing a configuration example of a recording head according to another embodiment.

Further, in the above described embodiment, in the first direction X, the piezoelectric layer 70 is disposed inside the pressure generating chamber 12; however, it is not limited thereto. For example, as illustrated in FIG. 11, in the first direction X, the piezoelectric layer 70A may be formed even on the vibration plate 50 between each piezoelectric element 300, and the second electrode 80A may be formed so as to extend even on the piezoelectric layer 70A formed to extend on the vibration plate 50. Even in the aspect, there is provided the liquid ejecting head, the liquid ejecting apparatus, and the piezoelectric device which can realize both securing the reliability and the excellent displacement properties, by satisfying the relationships of the thickness in a range in which a gist of the invention is not changed.

Moreover, in the above described embodiment, as an example of the liquid ejecting head, a liquid jet recording head is exemplified; however, the invention is provided to widely target the entirety of the liquid ejecting head, and can also be applied to the liquid ejecting head ejecting liquid other than ink. As a liquid ejecting head other than the above described liquid ejecting head, for example, there are various recording heads which is used to an image recording apparatus such as printer, a color material ejecting head which is used to manufacture a color filter such as liquid crystal display, an organic EL display, an electrode material ejecting head which is used to form an electrode such as a field emission display (FED), and a bio organic substance ejecting head which is used for manufacturing a bio chip.

In addition, the piezoelectric element according to the invention is not limited to the piezoelectric element used to the liquid ejecting head, and can be used to the other piezoelectric devices. Such a piezoelectric device includes a substrate 10 which is provided with at least one space, the vibration plate 50 which is stacked on one surface of the substrate 10 and seals the space, and the piezoelectric element 300 in which the first electrode 60, the piezoelectric layer 70, and the second electrode 80 are sequentially stacked on a surface opposite to the substrate 10 of the vibration plate 50. The first electrode 60 is formed, in which at least the width of the first direction is narrower than the space along the opposite surface in a region corresponding to the space, the piezoelectric layer 70 is stacked so as to overlap the first electrode 60 and at least a part of the vibration plate 50 in a region corresponding to the space, the second electrode 80 is stacked so as to overlap the piezoelectric layer 70 in a region corresponding to the space, a stacked direction of the piezoelectric element 300 is a thickness of the piezoelectric layer 70, and the first thickness (D1) of the piezoelectric layer 70 of a part positioned on the first electrode 60 and the second thickness (D2) of the piezoelectric layer 70 of a part positioned on the vibration plate 50 satisfy a relationship of the first thickness (D1)>the second thickness (D2). As a piezoelectric device other than these types described above, for example, there are ultrasonic devices such as an ultrasonic transmitter, an ultrasonic motor, temperature electric converter, a pressure-electric converter, a ferroelectric transistor, a piezoelectric transformer, a blocking filter of harmful rays such as infrared rays, an optical filter using photonic crystal effects by forming quantum dots, a filter such as an optical filter using optical interference of a thin film, and the like. In addition, the invention applied to a piezoelectric element using a sensor or a piezoelectric element used as a ferroelectric memory. As the sensor used in the piezoelectric element, for example, there are an infrared sensor, an ultrasonic sensor, a thermal sensor, a pressure sensor, a pyroelectric sensor, a gyro sensor (angular speed sensor), and the like.

In addition, the piezoelectric element 300 of the embodiment can be suitably used as a ferroelectric element. As the ferroelectric element which can be suitably used, for example, there are a ferroelectric transistor (FeFET), a ferroelectric arithmetic circuit (FeLogic), a ferroelectric capacitor, and the like. Further, the piezoelectric element 300 of the embodiment can be suitably used to a pyroelectric element by showing good pyroelectric properties. As the pyroelectric element which can be suitably used, for example, there are a temperature detector, a biological detector, an infrared detector, a terahertz detector, a heat-electric convertor, and the like.

What is claimed is:

1. A liquid ejecting head comprising:

a flow channel forming substrate that is provided with a space constituting a pressure generating chamber which communicates with nozzle openings;

a vibration plate that is stacked on one surface of the flow channel forming substrate and seals the space; and a piezoelectric element that includes a first electrode, a piezoelectric layer, and a second electrode sequentially stacked on a surface of the vibration plate opposite to the flow channel forming substrate, wherein the first electrode is formed, in which at least a width of a first direction along the opposite surface is narrower than the space in a region corresponding to the space, wherein the piezoelectric layer is stacked so as to overlap the first electrode and at least a part of the vibration plate in the region corresponding to the space, wherein the second electrode is stacked so as to overlap the piezoelectric layer in the region corresponding to the space, wherein when a thickness of a stacked direction of the piezoelectric element is a thickness of the piezoelectric layer, a first thickness (D1) of the piezoelectric layer of a part positioned on the first electrode and a second thickness (D2) of the piezoelectric layer of a part positioned on the vibration plate satisfy a relationship of the first thickness (D1)>the second thickness (D2), wherein the piezoelectric layer includes a first side surface which is inclined upwardly toward the center of the first direction, and a first upper surface formed continuously to the first side surface, and wherein a convex portion, which is wider than the first electrode in the first direction and is convex in a direction opposite to the vibration plate, is provided on the first upper surface.

2. The liquid ejecting head according to claim 1, wherein the first thickness (D1) is a thickness of the piezoelectric layer of a position including at least the center of the first direction in a part positioned on the first electrode.

3. The liquid ejecting head according to claim 1, wherein the first electrode includes a side surface which is inclined upwardly toward the center of the first direction, and an upper surface formed continuously to the side surface, wherein a ratio (first thickness (D1)/third thickness (D3)) of the first thickness (D1) to a third thickness (D3) of the piezoelectric layer on a boundary between the side surface and the upper surface, which is positioned on the first direction in the first electrode, is 90% or more.

4. The liquid ejecting head according to claim 1, wherein the convex portion is configured to have a second side surface inclined upwardly toward the center of the first direction and a second upper surface formed continuously to the second side surface, and wherein a first thickness (D1) is a distance between an upper surface of the first electrode and the second upper surface of the convex portion of the piezoelectric layer, and a second thickness (D2) is a distance between the vibration plate and the first upper surface of the piezoelectric layer.

5. The liquid ejecting head according to claim 1, wherein the piezoelectric element is configured to have a first piezoelectric layer that is formed by patterning at the same time as the first electrode and positioned on the first electrode and a second piezoelectric layer covering the first piezoelectric layer and the first electrode at least in the first direction, and wherein a fourth thickness (D4) of the convex portion in the second piezoelectric layer and a fifth thickness (D5) of the first electrode and the first piezoelectric layer satisfy a relationship of the fifth thickness (D5)>the fourth thickness (D4).

6. The liquid ejecting head according to claim 5, wherein a sixth thickness (D6) of the second piezoelectric layer between the upper surface of the first piezoelectric layer and the second upper surface of the convex portion of the second piezoelectric layer, and the second thickness (D2) satisfy a relationship of the second thickness (D2)>the sixth thickness (D6).

7. A liquid ejecting apparatus comprising the liquid ejecting head according to claim 1.

8. A liquid ejecting apparatus comprising the liquid ejecting head according to claim 2.

9. A liquid ejecting apparatus comprising the liquid ejecting head according to claim 3.

10. A liquid ejecting apparatus comprising the liquid ejecting head according to claim 4.

11. A liquid ejecting apparatus comprising the liquid ejecting head according to claim 5.

12. A liquid ejecting apparatus comprising the liquid ejecting head according to claim 6.

13. A piezoelectric device comprising:

a substrate that includes at least one space;

a vibration plate that is stacked on one surface of the substrate and seals the space; and a piezoelectric element that includes a first electrode, a piezoelectric layer, and a second electrode sequentially stacked on a surface of the vibration plate opposite to the substrate, wherein the first electrode is formed, in which at least a width of a first direction along the opposite surface is narrower than the space in a region corresponding to the space, wherein the piezoelectric layer is stacked so as to overlap the first electrode and at least a part of the vibration plate in the region corresponding to the space, wherein the second electrode is stacked so as to overlap the piezoelectric layer in the region corresponding to the space, wherein when a thickness of a stacked direction of the piezoelectric element is a thickness of the piezoelectric layer, a first thickness (D1) of the piezoelectric layer of a part positioned on the first electrode and a second thickness (D2) of the piezoelectric layer of a part positioned on the vibration plate satisfy a relationship of the first thickness (D1)>the second thickness (D2), wherein the piezoelectric layer includes a first side surface which is inclined upwardly toward the center of the first direction, and a first upper surface formed continuously to the first side surface, and wherein a convex portion, which is wider than the first electrode in the first direction and is convex in a direction opposite to the vibration plate, is provided on the first upper surface.

* * * * *